US005782512A

United States Patent [19]

Cargnoni

[11] Patent Number: 5,782,512

[45] Date of Patent: Jul. 21, 1998

[54] MAGNETIC FIELD LATCH ASSEMBLY

[75] Inventor: James P. Cargnoni, Shortsville, N.Y.

[73] Assignee: Xerox Corporation, Stamford, Conn.

[21] Appl. No.: 781,305

[22] Filed: Jan. 13, 1997

[51] Int. Cl.[6] ..... E05C 17/56

[52] U.S. Cl. ..... 292/251.5; 292/DIG. 60

[58] Field of Search ..... 292/251.5, 341.12, 292/DIG. 73, DIG. 60

[56] References Cited

U.S. PATENT DOCUMENTS

| | | | |
|---|---|---|---|
| 2,565,891 | 8/1951 | Sherman | 292/251.5 |
| 2,904,364 | 9/1959 | Korodi | 292/251.5 |
| 2,932,545 | 4/1960 | Foley | 292/251.5 X |
| 3,079,535 | 2/1963 | Schultz | 292/251.5 X |
| 3,376,615 | 4/1968 | Heckman | 292/251.5 X |
| 3,691,688 | 9/1972 | Kaiserswerth | 292/251.5 X |
| 3,781,047 | 12/1973 | Surke, Jr. | 292/251.5 |
| 3,790,197 | 2/1974 | Parker | 292/251.5 |
| 3,860,300 | 1/1975 | Lyman | 308/10 |
| 3,962,632 | 6/1976 | Hardy et al. | 324/137 |
| 4,381,889 | 5/1983 | Sahara et al. | 354/41 |
| 4,484,761 | 11/1984 | Knabel et al. | 292/251.5 X |
| 4,912,727 | 3/1990 | Schubert | 292/251.5 X |
| 5,414,577 | 5/1995 | Arin et al. | 360/105 |

FOREIGN PATENT DOCUMENTS

| | | | |
|---|---|---|---|
| 3041572 | 6/1982 | Germany | 292/251.5 |
| 3744707 | 9/1988 | Germany | 49/472 |
| 198956 | 10/1965 | Sweden | 292/251.5 |
| 573454 | 11/1945 | United Kingdom | 292/251.5 |
| 1009996 | 11/1965 | United Kingdom | 292/251.5 |
| 2223793 | 4/1990 | United Kingdom | 292/251.5 |

*Primary Examiner*—Suzanne Dino Barrett
*Attorney, Agent, or Firm*—Oliff & Berridge, PLC

[57] ABSTRACT

A magnetic field latch assembly for an apparatus having a first element and a second element with the second element having a disengaged position and an engaged position with respect to the first element. The magnetic field latch assembly employs permanent or electromagnets for shock absorption, positioning and latching the first element and the second element. The magnetic field latch assembly includes magnets associated with the first and second elements such that as the first and second elements approach each other, the magnets initially repel each other causing a braking force to slow the relative motion of the first and second elements. When the first and second elements are in the engaged position, the magnets hold the first and second elements in position and minimize vibration and chatter.

19 Claims, 14 Drawing Sheets

MAGNETIC FIELD LATCH ASSEMBLY

BACKGROUND OF THE INVENTION

1. Field of the Invention

This invention relates to a magnetic field latch assembly.

2. Description of Related Art

Conventional latch systems, such as mechanical latches, provide positive latching between parts so that minute vibrations between latched parts are prevented. However, when the parts are also required to separate quickly, the mechanical latches release too slowly. Thus, there is a need to provide a latch that inhibits vibrations and provides for quick releases.

SUMMARY OF THE INVENTION

The present invention provides a magnetic field latch assembly that includes two or more magnets. At least one of the magnets is mounted on or near a first element and the other magnet is mounted on or near a second element.

The magnetic poles of the magnets are arranged to provide a first force acting in a first direction that tends to push the first and the second elements apart when the first and the second elements are in a disengaged position. The first force increases as the first element approaches the second element. When the first and the second elements are close, the first force tending to separate the first and the second elements decreases, and the magnets exert a second force that tends to push the first and the second elements together. When the first and the second elements are in an engaged position, the second force produced by the magnets creates a magnetic latch effect.

By arranging the magnets in this fashion, the first force slows the relative motion of the first and the second elements, thereby limiting shock that may occur when the first and the second elements reach the engaged position. When the first and the second elements are in the engaged position, the magnetic latch minimizes vibration between the first and the second elements while allowing quick disengagement of the first and the second elements.

BRIEF DESCRIPTION OF THE DRAWINGS

The invention is described in detail with reference to the following drawings, wherein like numerals represent like elements, and wherein.

DETAILED DESCRIPTION OF PREFERRED EMBODIMENTS

This invention provides a magnetic field latch assembly that employs at least two magnets. A first magnet is associated with a first element and a second magnet is associated with a second element. The magnetic field latch assembly relies on the repelling and attracting forces between the two magnets to slow the motion of the first element with respect to the second element, and to then uses the magnetic field to latch the first and the second elements together.

Figure 1A:
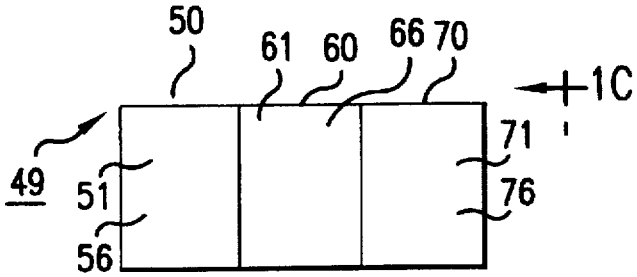
FIG. 1A is a plan view of a magnetic field latch assembly.
Figure 1B:
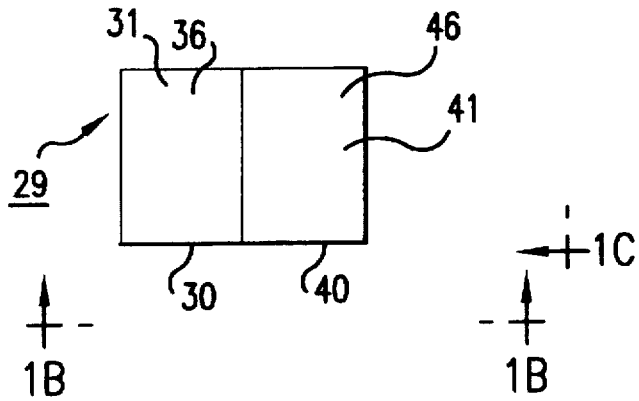
FIG. 1B is a front view of the magnets shown in FIG. 1A.
Figure 1B:
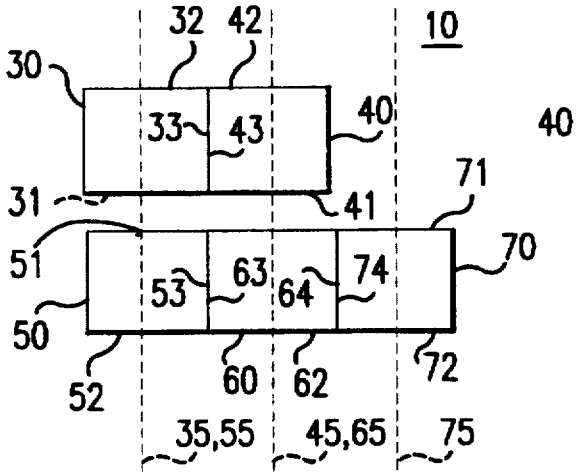
Figure 1C:
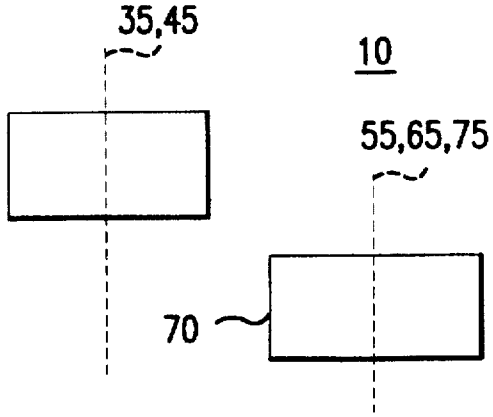
FIG. 1C is a side view of the magnets shown in FIG. 1A.

The magnetic field latch assembly can employ many different magnet configurations to produce a magnetic latch. In particular, the magnetic field latch assembly can include two or more sets of magnets, each set of magnets including two or more magnets. FIGS. 1A–1C show an example of one arrangement of magnets for the magnetic field latch assembly.

In FIGS. 1A–1C, a magnetic field latch assembly 10 includes a first magnet set 29 including magnet 30 with sides 31, 32 and 33 and magnet 40 with sides 41, 42 and 43; and a second magnet set 49 including magnet 50 with sides 51, 52 and 53; magnet 60 with sides 61, 62, 63 and 64; and magnet 70 with sides 71, 72 and 74. Magnets 30 and 40 have magnet axes 35 and 45 from a north magnetic pole to a south magnetic pole, and magnets 50, 60 and 70 have magnet axes 55, 65 and 75 respectively, from a north magnetic pole to a south magnetic pole. The magnet axes 35 and 45 are substantially parallel and the magnet axes 55, 65 and 75 are substantially parallel. The magnets 30 and 40 are further arranged so that the sides 31 and 41 lie in substantially a same plane, the sides 32 and 42 lie in substantially a same plane, and the sides 33 and 43 are adjacent to each other. Similarly, the magnets 50, 60 and 70 are arranged so that the sides 51, 61 and 71 lie in substantially a same plane; the sides 52, 62 and 72 lie in substantially a same plane; the sides 53 and 63 are adjacent to each other; and the sides 64 and 74 are adjacent to each other.

The magnets 30 and 40 are also arranged so that the side 31 contains a magnetic pole 36 of opposite polarity from a magnetic pole 46 of the side 41 (e.g., side 31 contains a north magnetic pole and side 41 contains a south magnetic pole). Similarly, the magnets 50, 60 and 70 are also arranged so that the sides 51 and 71 contain north magnetic poles 56 and 76, respectively, and the side 61 contains a south magnetic pole 66.

As can be appreciated, other arrangements of the magnets 30–70 can be used in a magnetic field latch assembly. In particular, the magnet sets 29 and 49 can contain more than two and three magnets, respectively, and magnet set 49 can contain two magnets. Adding additional magnets to the second magnet set 49, for example, may increase or decrease the attracting and repelling forces between the magnet sets 29 and 49. Alternately, the magnet sets 29 and 49 can contain one magnet such as magnets 30 and 50 with the magnets be arranged so that side 31 contains, for example, a north magnetic pole and side 51 contains a south magnetic pole. Finally, although shown as rectangular in shape in FIGS. 1A–1C, the magnets 30–70 could be other shapes such as cylindrical, for example.

Figure 2A:
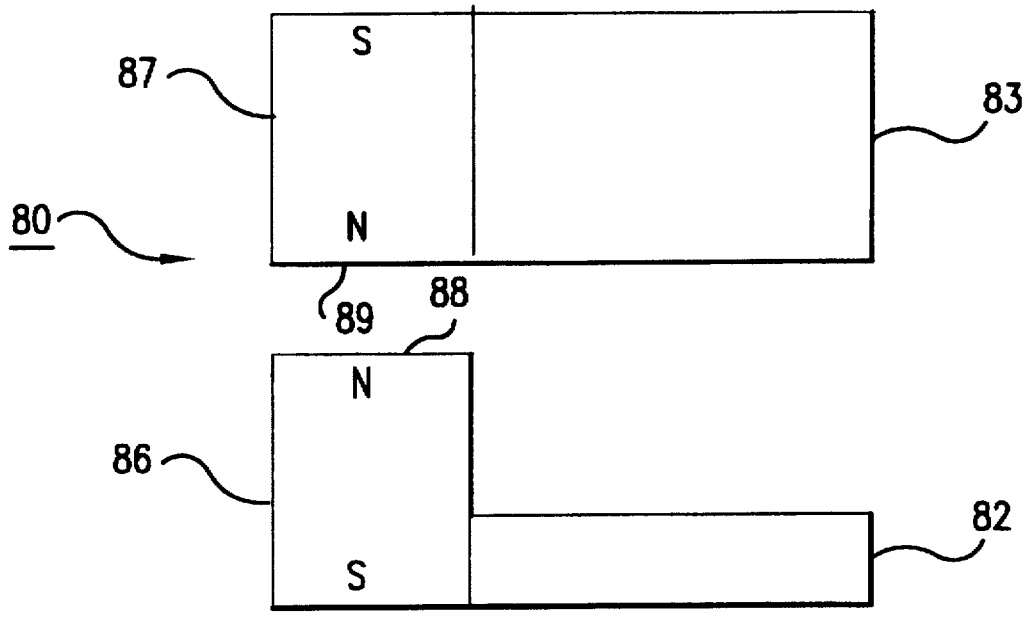
FIG. 2A is a plan view of a first magnetic field latch assembly for latching a first element and a second element in a disengaged position.
Figure 2C:
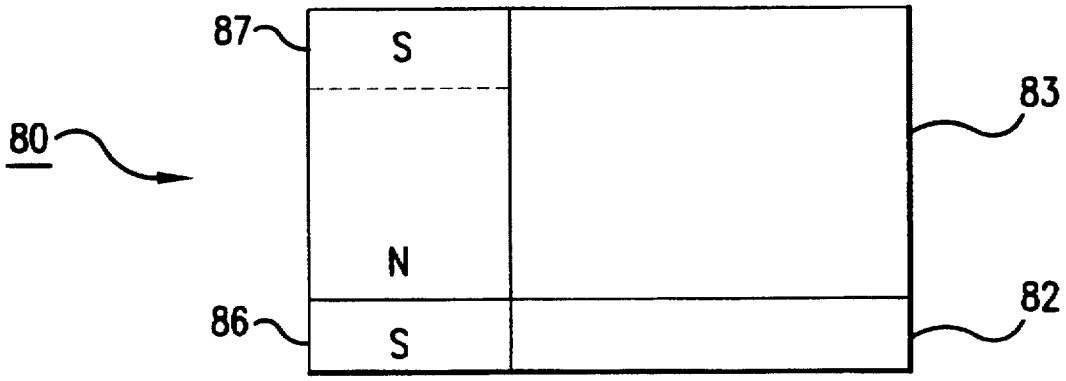
FIG. 2C is a plan view of the first magnetic field latch assembly of FIG. 2A in an engaged position.
Figure 2B:
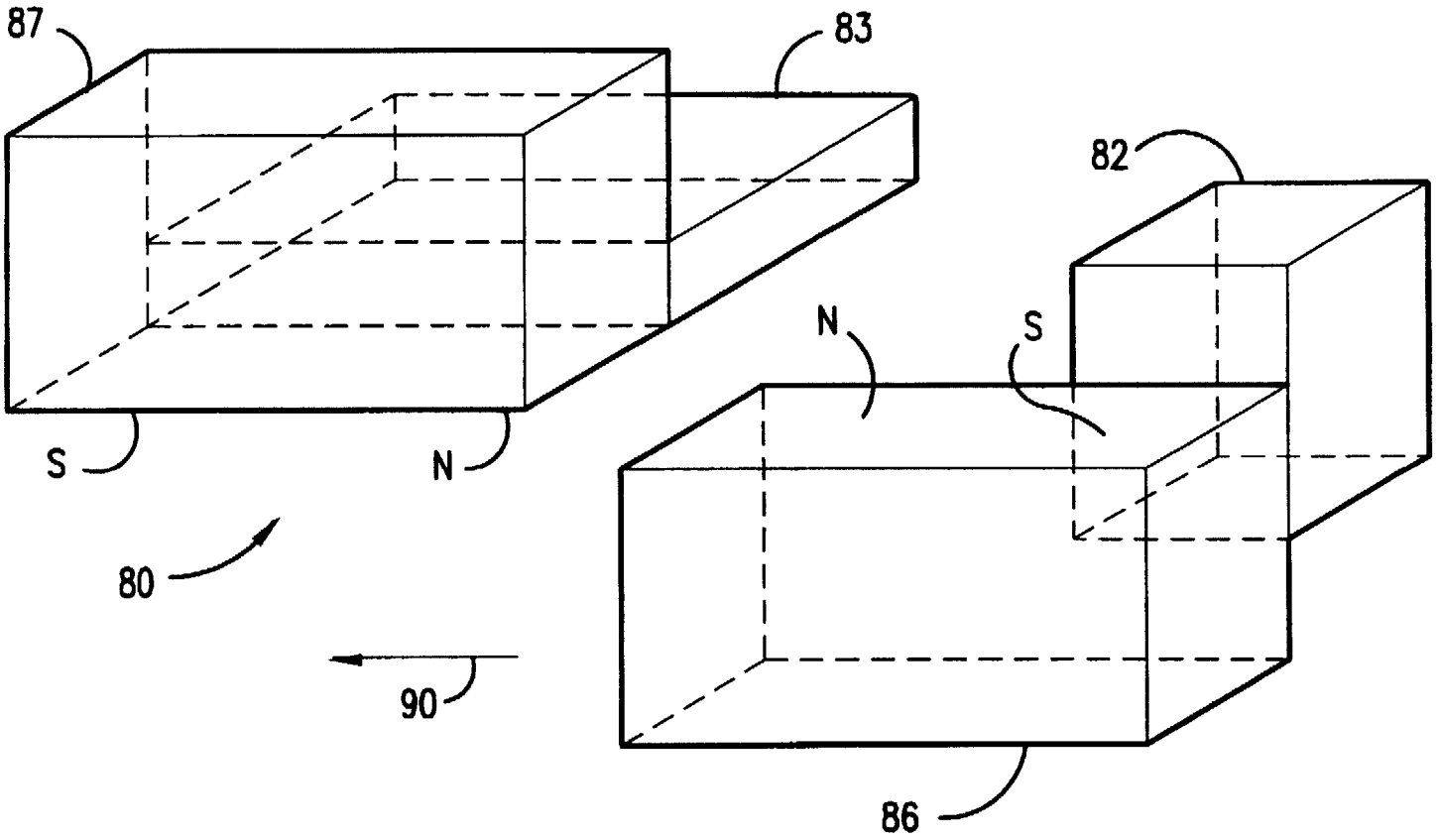
FIG. 2B is a perspective view of the magnetic field latch assembly of FIG. 2A.

FIGS. 2A–2C show a magnetic field latch assembly 80 for latching a first and a second element. In FIG. 2A–2C, the first element is a movable element 82 and the second element is a stationary element 83. The magnetic field latch assembly 80 includes at least two magnets, such as magnets 86 and 87. Magnet 86 is attached to the movable element 82. Magnet 87 is attached to the stationary element 83.

In FIG. 2A, the movable element 82 is shown in a disengaged position from the stationary element 83. The disengaged position includes any position in which forces created by the magnets 86 and 87 tend to separate the movable element 82 and the stationary element 83. In the disengaged position, the magnetic poles of the magnets 86 and 87 are arranged so that N poles are approximately opposite to each other.

FIG. 2B shows a perspective view of the magnetic field latch assembly 80 with the movable element 82 moving toward an engaged position as shown by arrow 90. As shown in FIG. 2B, the magnet 86 is located on a plane below the magnet 87. During the movement of the movable element 82 toward the engaged position, the same polarity of the magnets 86 and 87 creates a repelling force that tends to slow the motion of the movable element 82 toward the stationary element 83.

FIG. 2C shows the magnetic field latch assembly 80 with the movable element 82 in the engaged position. In the engaged position, the magnets 86 and 87 horizontally overlap each other and the north magnetic pole of the magnet 86 is positioned between the north and south poles of the magnet 87 so that the magnets 86 and 87 are drawn to further overlap each other by forces between the magnetic poles of the magnets 86 and 87. This arrangement of the magnetic poles creates a magnetic latch that holds the movable element 82 close to the stationary element 83 when engaged.

Figure 3:
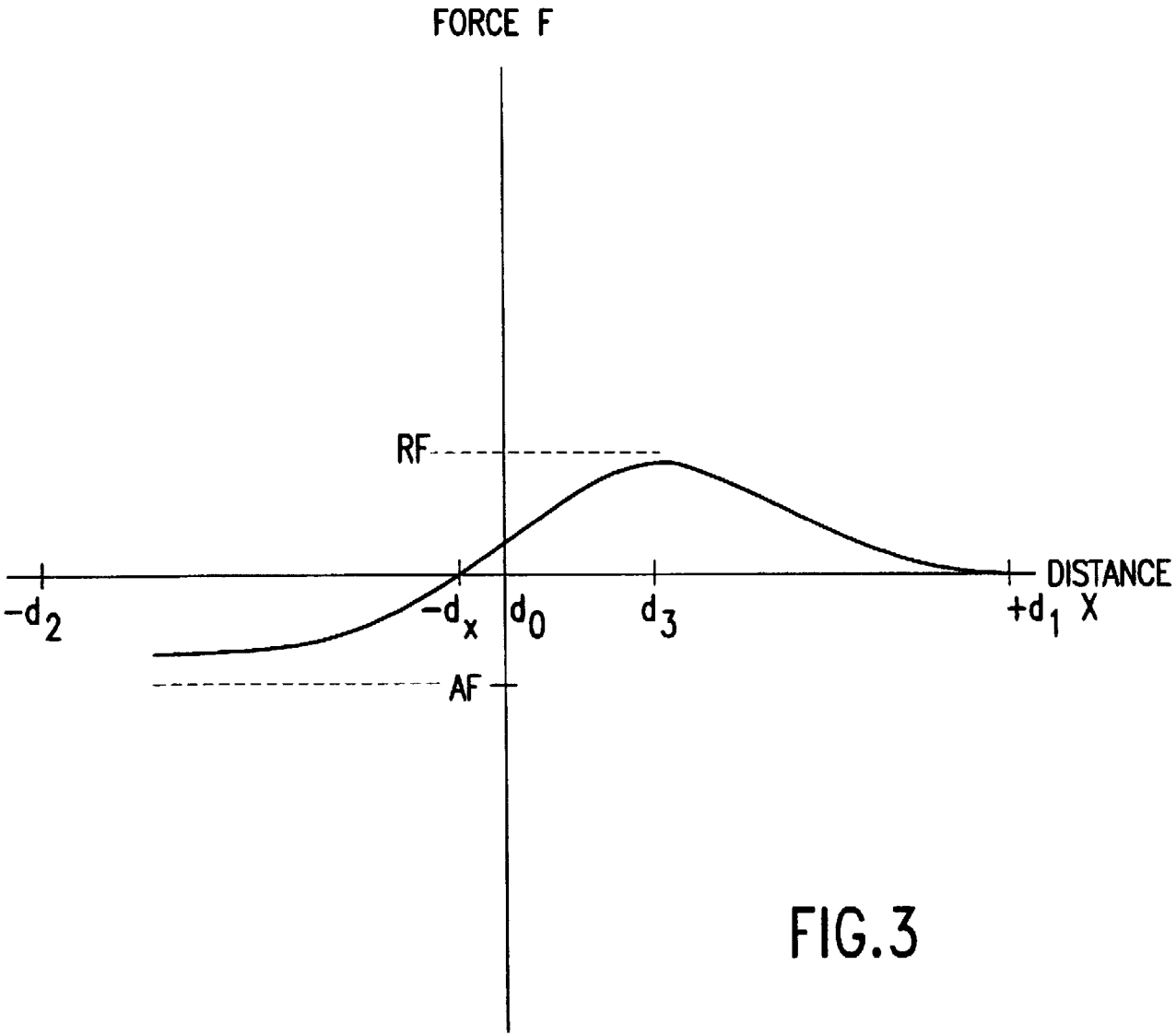
FIG. 3 shows a graph of net magnetic forces acting on the first and second elements.

FIG. 3 shows a diagram of a force F acting on the movable element 82 by the magnets 86 and 87 as the movable element 82 moves in an engaging direction toward the stationary element 83. The vertical axis indicates the force F acting on the movable element 82. The horizontal axis indicates the distance between the movable element 82 and the stationary element 83. The force F along the horizontal axis is zero (0). The force F above the horizontal axis tends to separate (i.e., act in a disengaging direction) the movable element 82 and the stationary element 83. The force F below the horizontal axis tends to draw (i.e., act in an engaging direction) the movable and stationary elements 82 and 83 together.

The distance between the movable element 82 and the stationary element 83 increases along the horizontal axis to the right of the origin. At the origin, surfaces 88 and 89 of the magnets 86 and 87, respectively, are aligned in a common plane. The movable and stationary elements 82 and 83 are drawn close together so that the magnets 86 and 87 overlap each other along the horizontal axis to the left of the origin until the movable and stationary elements 82 and 83 engage at $-d_2$.

The force F varies between values RF and AF. In other words, when the force F is between zero and some maximum value of RF, it acts in a disengaging direction. When the force F is between zero and some maximum value of AF, it acts in an engaging direction. The movable element 82 moves from the disengaged position at $+d_1$ to the engaged position at $-d_2$ along the horizontal axis. In between the disengaged and the engaged positions, the movable element 82 passes a position $+d_3$ at which the force F reaches RF, which is a maximum force that tends to separate the movable and stationary elements 82 and 83 by acting in the disengaging direction. As the movable element 82 continues toward the engaged position $-d_2$, the magnets 86 and 87 continue to repel each other, but the force repelling decreases. At position $d_0$, the surface 88 of the magnet 86 is aligned with the surface 89 of the magnet 87 and at position $-d_x$, the force F is zero. From position $-d_x$ on toward the engaged position $-d_2$, the magnets 86 and 87 are drawn toward each other and the value of the F force increases toward a maximum force AF in the engaging direction.

Figure 4A:
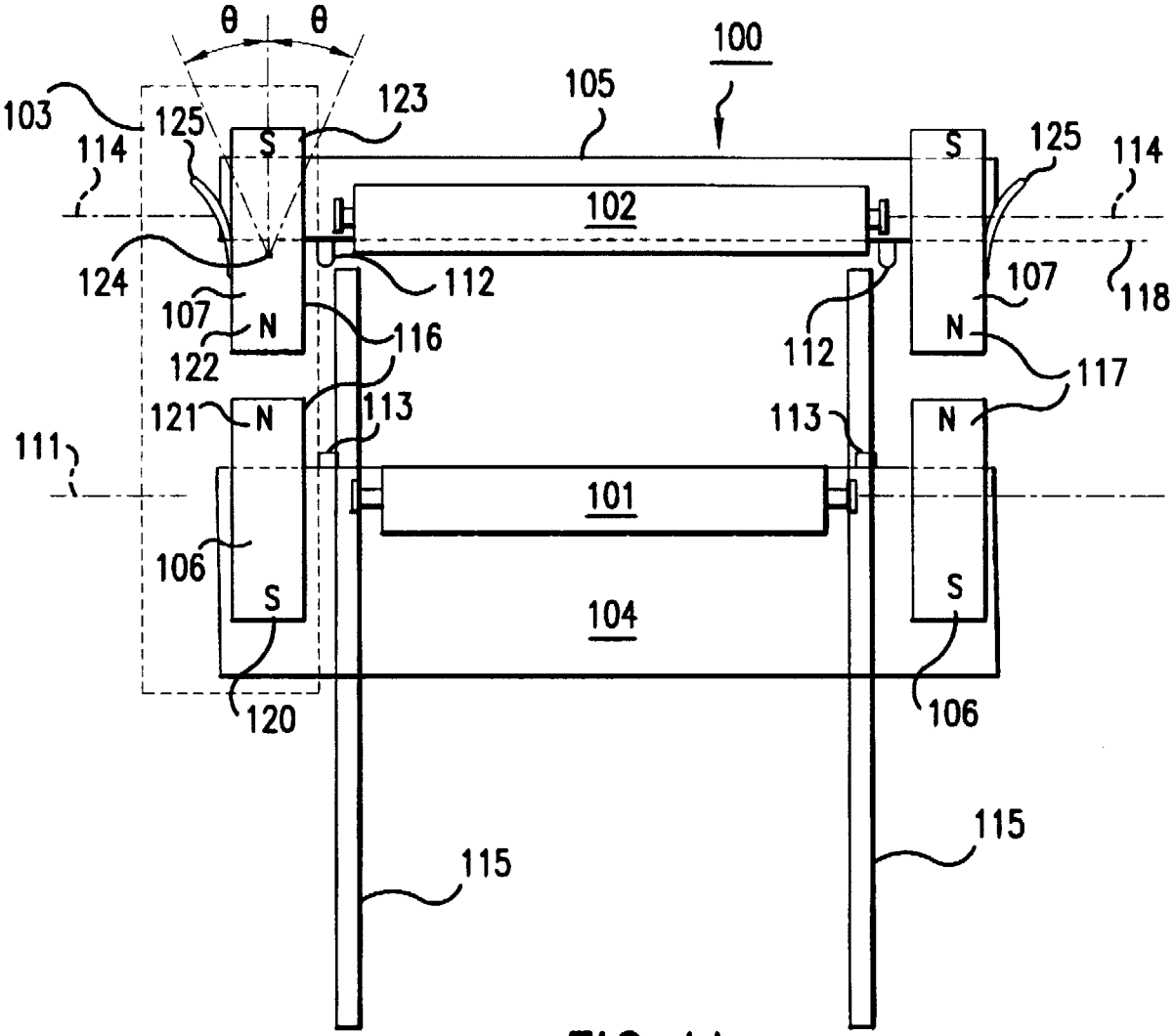
FIG. 4A is a plan view of an example of the first magnetic field latch assembly for latching a movable element and a stationary element, with the movable element in the disengaged position.
Figure 4B:
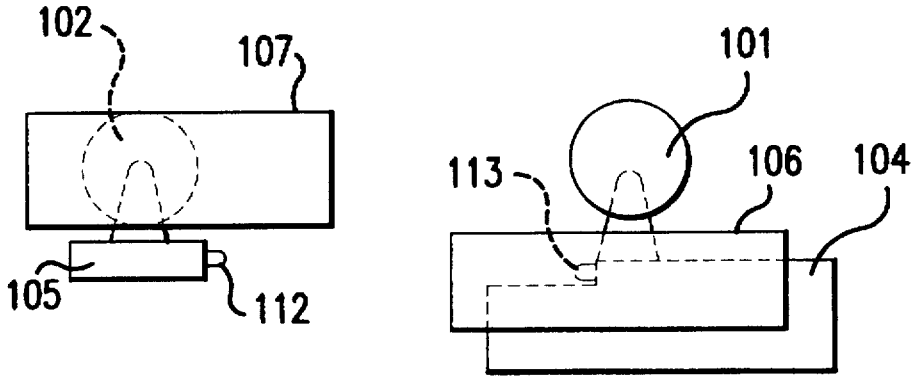
FIG. 4B is a side view of the magnetic field latch assembly of FIG. 4A.
Figure 4D:
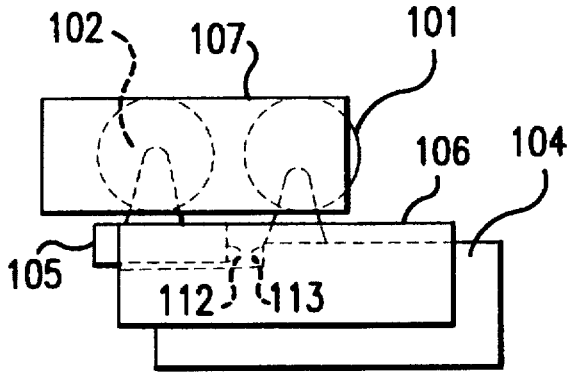
FIG. 4D is a side view of the magnetic field latch assembly of FIG. 4C.

FIG. 4A shows an application of the magnetic field latch assembly. An apparatus 100 has a movable element 101, a stationary element 102, and a magnetic field latch assembly 103 for coupling the movable element 101 to the stationary element 102. The movable element 101 is disposed in a carriage 104, and may be free to rotate about its longitudinal axis 111. The stationary element 102 is disposed in a frame 105 and may be free to rotate about its longitudinal axis 112. FIG. 4B shows a side view of the magnetic field latch assembly of FIG. 4A.

Figure 4C:
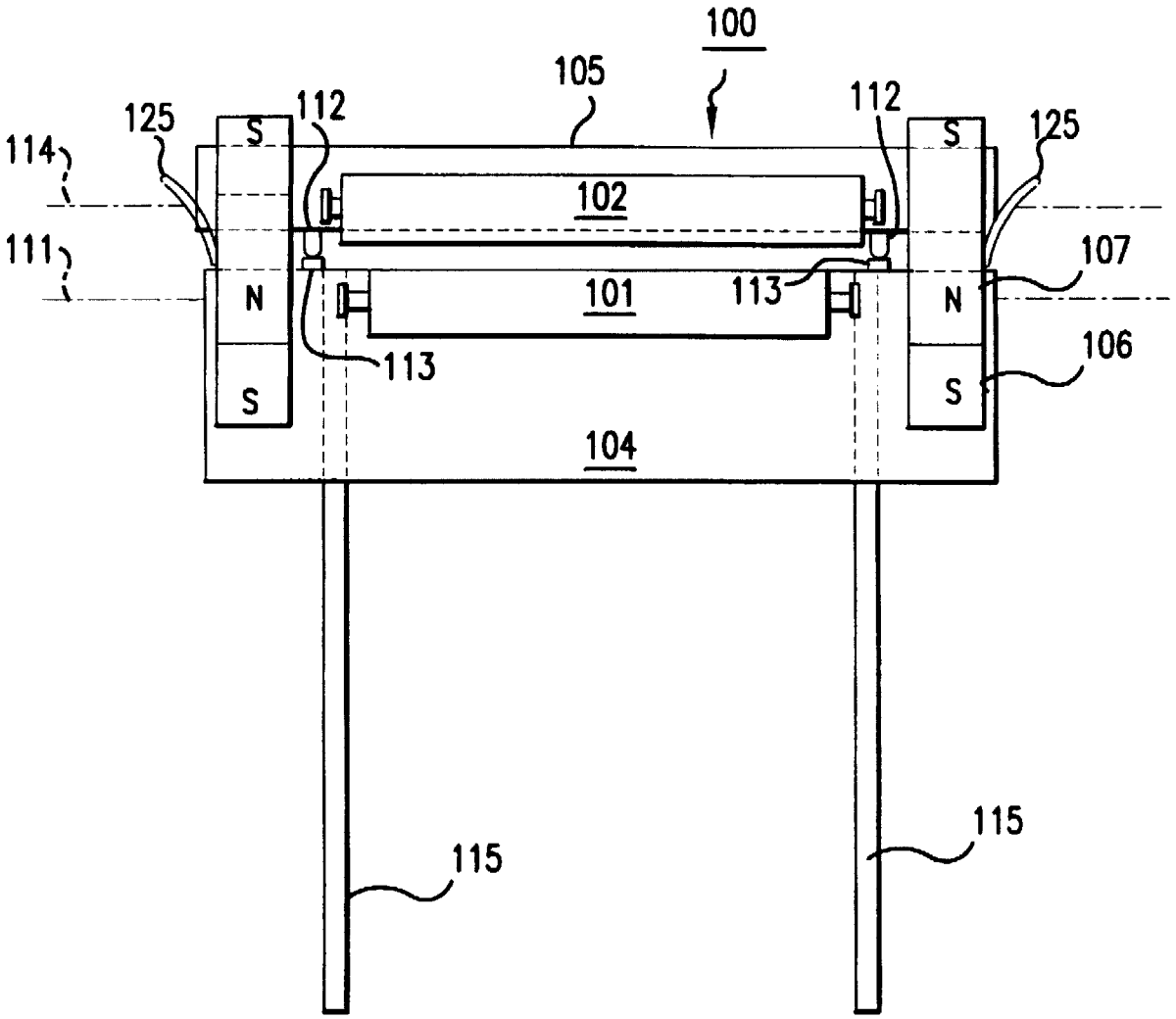
FIG. 4C is a plan view of the second magnetic field latch assembly of FIG. 4A in the engaged position.

The movable element 101 operates between a disengaged position shown in FIG. 4A and an engaged position shown in FIG. 4C. The movable element 101 moves from the disengaged position to the engaged position along carriage tracks 115. When the movable element 101 is engaged with the stationary element 102, a gap between the movable and stationary elements 101 and 102 is closely controlled by the physical arrangement of carriage stops 112 on the frame 105 in contact with carriage stop plates 113 on the carriage 104. Thus, the magnetic field latch assembly 103 allows close coupling of the movable element 101 and the stationary element 102 while minimizing vibration between the movable and stationary elements 101 and 102 during operation of the apparatus 100.

Located along either end of the movable element 101 and the stationary element 102 is at least one set of magnets 106 and 107, respectively. Although FIG. 4A shows two sets of magnets, namely sets 116 and 117, it should be understood that one set of magnets, or more than two sets of magnets could be used in the magnetic field latch assembly 103. Furthermore, each set of magnets can include a plurality of magnets, and the magnets can be oriented in a plurality of ways, such as is shown in FIGS. 1A–1C, for example.

The magnets 106 and 107 are on or near the longitudinal axes 111 and 114, respectively, of the movable element 101 and the stationary element 102. The magnetic poles 120–123 of the magnets 106 and 107 are arranged such that when the carriage 104 is in the disengaged position, the magnets 106 and 107 repel each other and when the carriage 104 is engaged, the magnets 106 and 107 are drawn to each other.

The magnets 106 and 107 may be magnets such as iron, ceramic and electric magnets. The choice of magnets depends on application requirements such as an explosion-proof environment or the strength of the magnetic force that is required.

In this embodiment, the magnets 107 can move in at least two ways. The magnets 107 can pivot about a center point 124. The orientation of the magnets 107 adjacent to the stationary element 102 can be adjusted through an angle Θ by means of flexible levers 125, attached to the magnets 107. In addition, the flexible levers 125 are used to position the magnets 107 along a longitudinal axis 118 that is substantially parallel to the longitudinal axis 114 of the stationary member 102.

The flexible levers 125 are simple spring steel levers that are attached to a face of the magnets 107 away from the stationary element 102. By adjusting the longitudinal position and orientation of the magnets 107 in this manner, minor adjustments can be made to the forces between the magnets 106 and 107, and a force $F_y$ acting parallel to the longitudinal axis 111 of the movable element 101 can be created. The force $F_y$ acting parallel to the longitudinal axis 111 of the movable element 101 can also be used to slow the motion of the movable element 101 toward the stationary element 102 by increasing a frictional force acting on the carriage 104 as the carriage 104 moves along the carriage tracks 115.

Figure 4E:
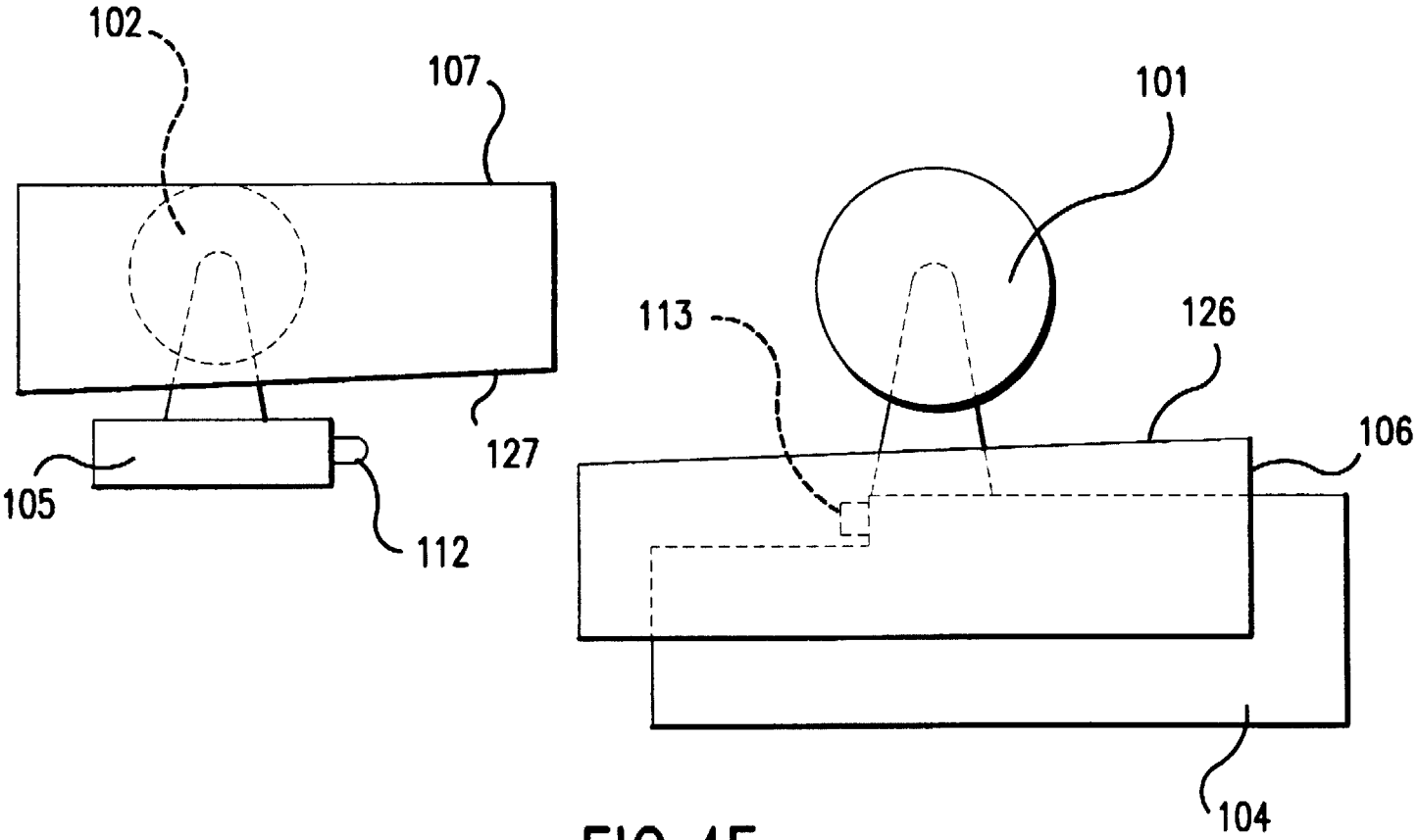
FIG. 4E shows another side view of the magnetic field latch assembly of FIG. 4A.

When in the engaged position, the magnets 106 and 107 may be either separated from each other by a small gap or in contact with each other. The magnets 106 and 107 come in contact immediately before the engaged position is reached. The physical contact between the magnets provides an additional frictional force that further slows the motion of the carriage 104 toward the frame 105. As shown in FIG. 4E, faces 126 and 127 of the magnets 106 and 107, respectively, are tapered slightly so that immediately before the engaged position is reached, a controlled slight physical contact occurs between the magnets 106 and 107.

The magnetic field latch created by magnets 106 and 107 ensures a reduction of vibration between the movable element 101 and the stationary element 102. The amount of allowable vibration may be controlled by the selection of an appropriate type of magnet such as iron or ceramic permanent magnets or electromagnets, a size of the magnets and the orientation and longitudinal position of the magnets and the frictional forces between the magnets.

The magnets 106 and 107 may be any combination of permanent and/or electromagnets. When some or all the magnets 106 and 107 are electromagnets, the electromagnets are activated to attract each other when the carriage 104 is in the engaged position. Once activated, the electromagnets hold the movable element 101. When the carriage 104 is moving from the disengaged position to the engaged position, the electromagnets can be activated to provide a repelling force to slow the motion of the carriage 104. When the carriage 104 is in the engaged position, the polarity of one of the electromagnets can be reversed to achieve the desired magnetic latch.

Figure 5A:
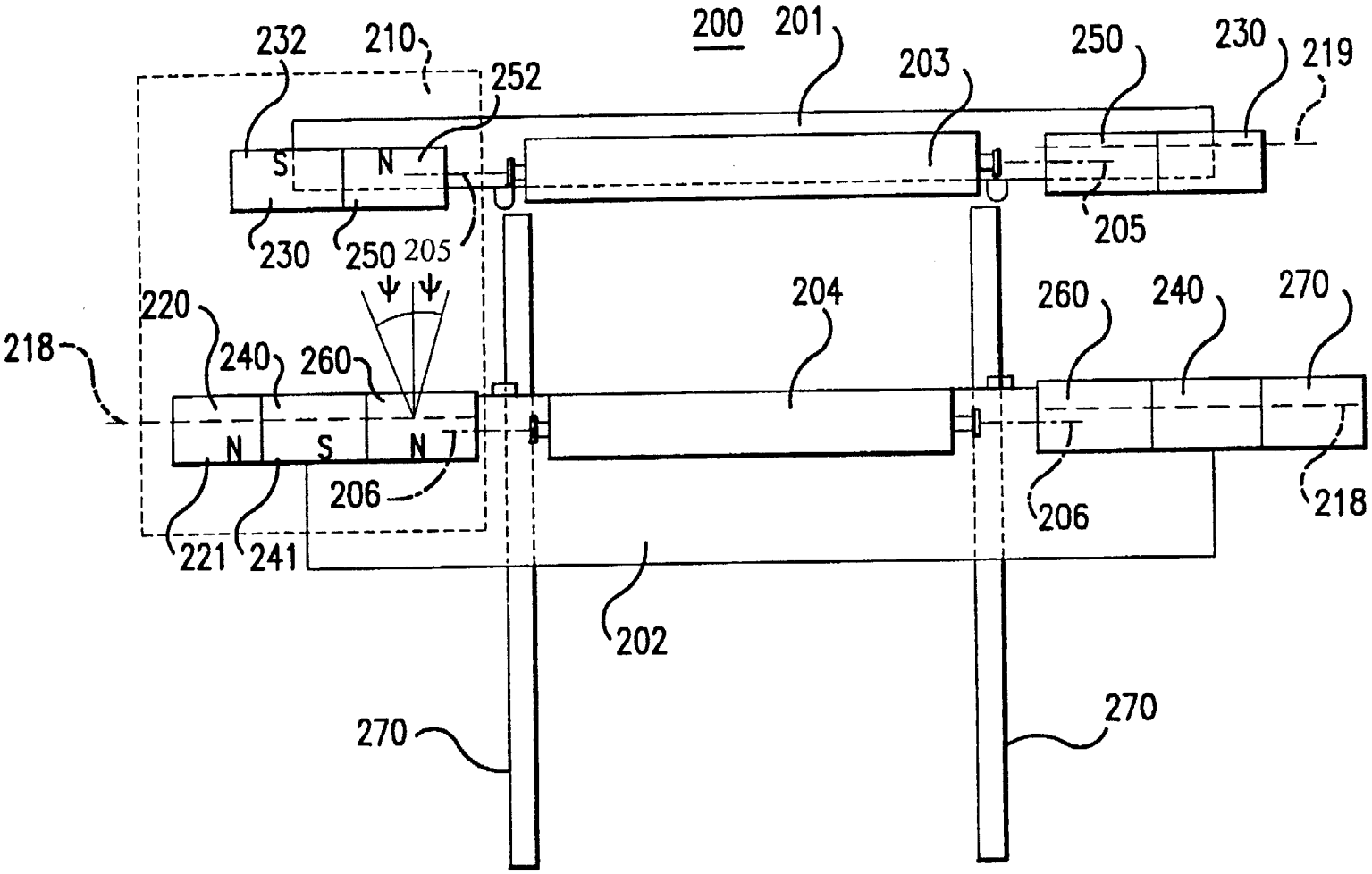
FIG. 5A is a plan view of a second magnetic field latch assembly with the movable element disengaged.

FIG. 5A shows another embodiment of an apparatus 200 with a magnetic field latch assembly 210. A stationary element 203 is disposed in a frame 201 of the apparatus 200. Magnets 230 and 250 are located in the frame 201. A longitudinal axis 219 of the magnets 230 and 250 is approximately parallel to a longitudinal axis 205 of the stationary element 203.

The magnets 230 and 250 are permanent magnets and are coupled together. The magnets 230 and 250 can slide along the longitudinal axis 219. The position of the magnets 230 and 250 along the longitudinal axis 219 affects the repulsive and attractive forces exerted between the magnets 230 and 250 and other magnets.

Figure 5B:
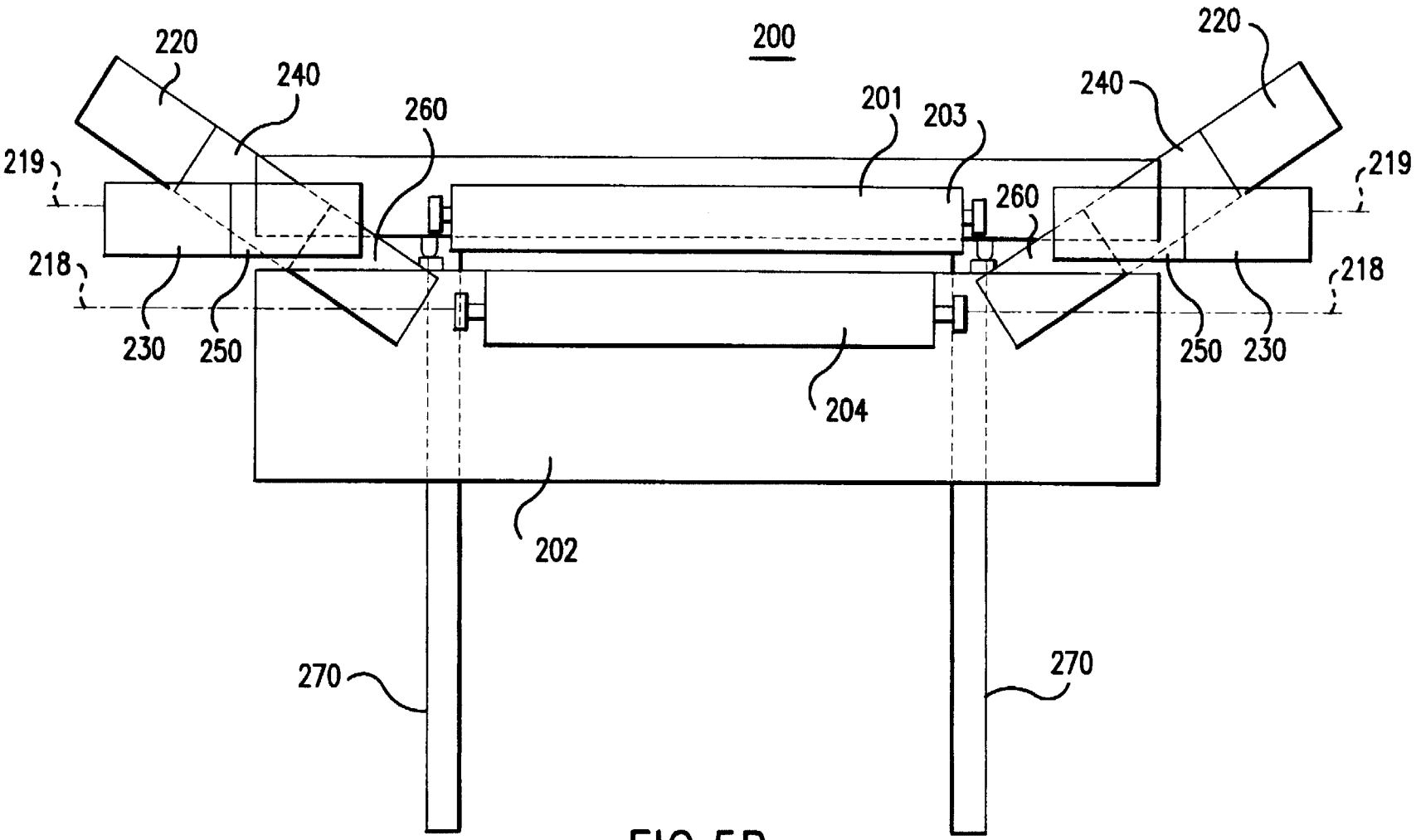
FIG. 5B is a plan view of the second magnetic field latch assembly with the movable element engaged.

A movable element 204 is located in a carriage 202. The carriage 202 moves between a disengaged position as shown in FIG. 5A and an engaged position as shown in FIG. 5B. The carriage 202 slides on carriage tracks 270. Magnets 220, 240 and 260 are located on the carriage 202 and have a longitudinal axis 218 that is approximately parallel to a longitudinal axis 206 of the movable element 204. North magnetic poles 221 and 261 are at a top of the magnets 220 and 260, respectively; a south magnetic pole 241 is at the top of the magnet 240; a south magnetic pole 232 is at a bottom of the magnet 230; and a north magnetic pole 252 is at a bottom of the magnet 250. As shown in FIG. 5A, magnets 220, 240 and 260 are coupled together with magnet 240 positioned between magnets 220 and 260.

Figure 8:
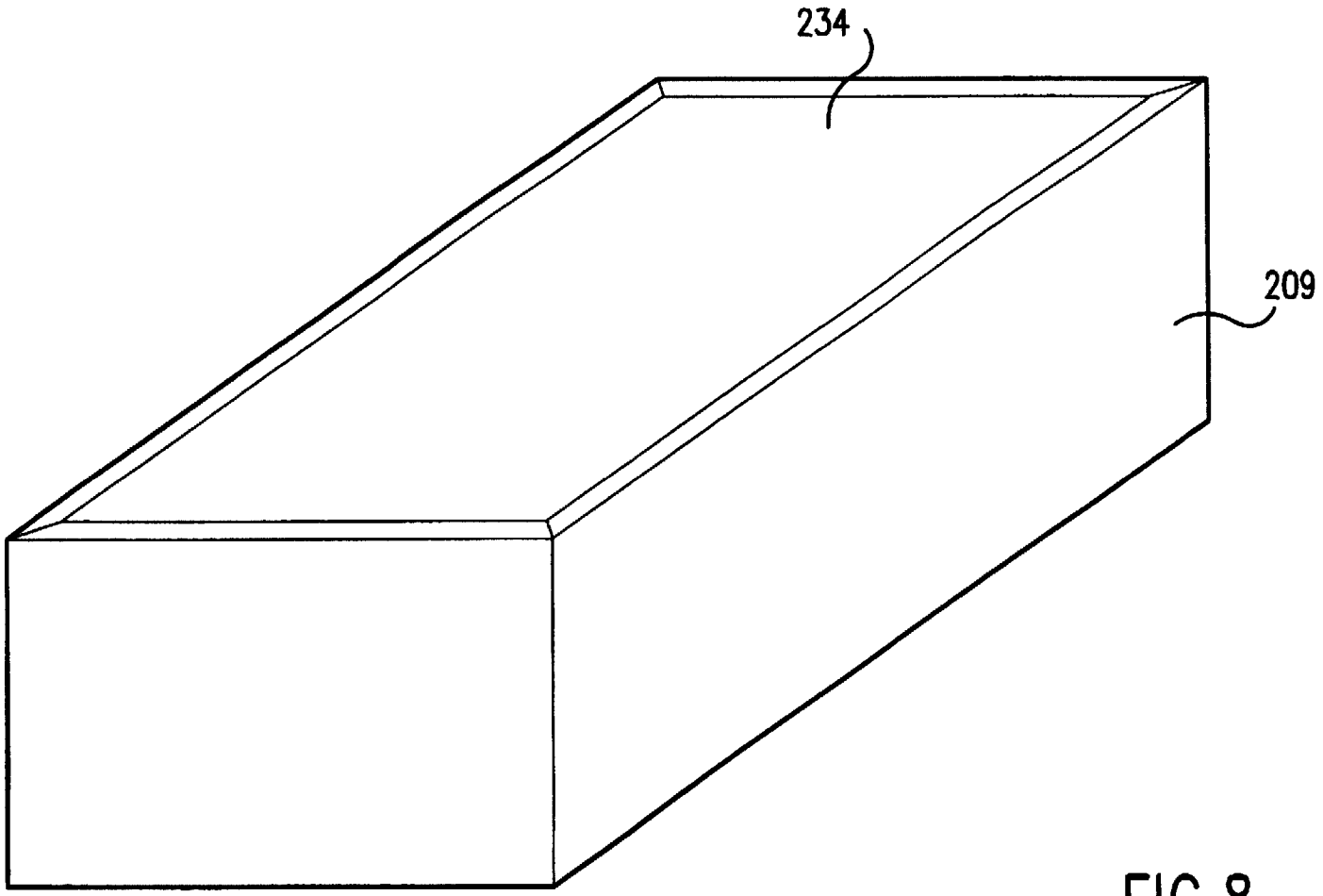
FIG. 8 shows a shield assembly.

The magnets 220–260 can also be enclosed in shields 209. The shield arrangement is shown in FIG. 8. The shield includes a thin material such as sheet steel, approximately ⅛ inch thick, covering all but a side 234 of the magnet 230 that contains the south magnetic pole 232, for example. The side 234 is covered by a thin, magnetically permeable material such as a mylar film or sheet aluminum. The magnets 220–260 are fixed in the shields 209 by, for example gluing. The shields 209 prevent close contact between the magnets 220–260 and objects that could be damaged by close proximity to the magnets 221–225.

The magnets 220, 240 and 260 can rotate through an angle ψ as shown in FIG. 5A, where ψ is between about ±45°. By rotating magnets 220, 240 and 260 through the angle ψ, the attractive and repulsive forces between magnets 220, 240 and 260 and magnets 230 and 250 can be varied.

Figure 5C:
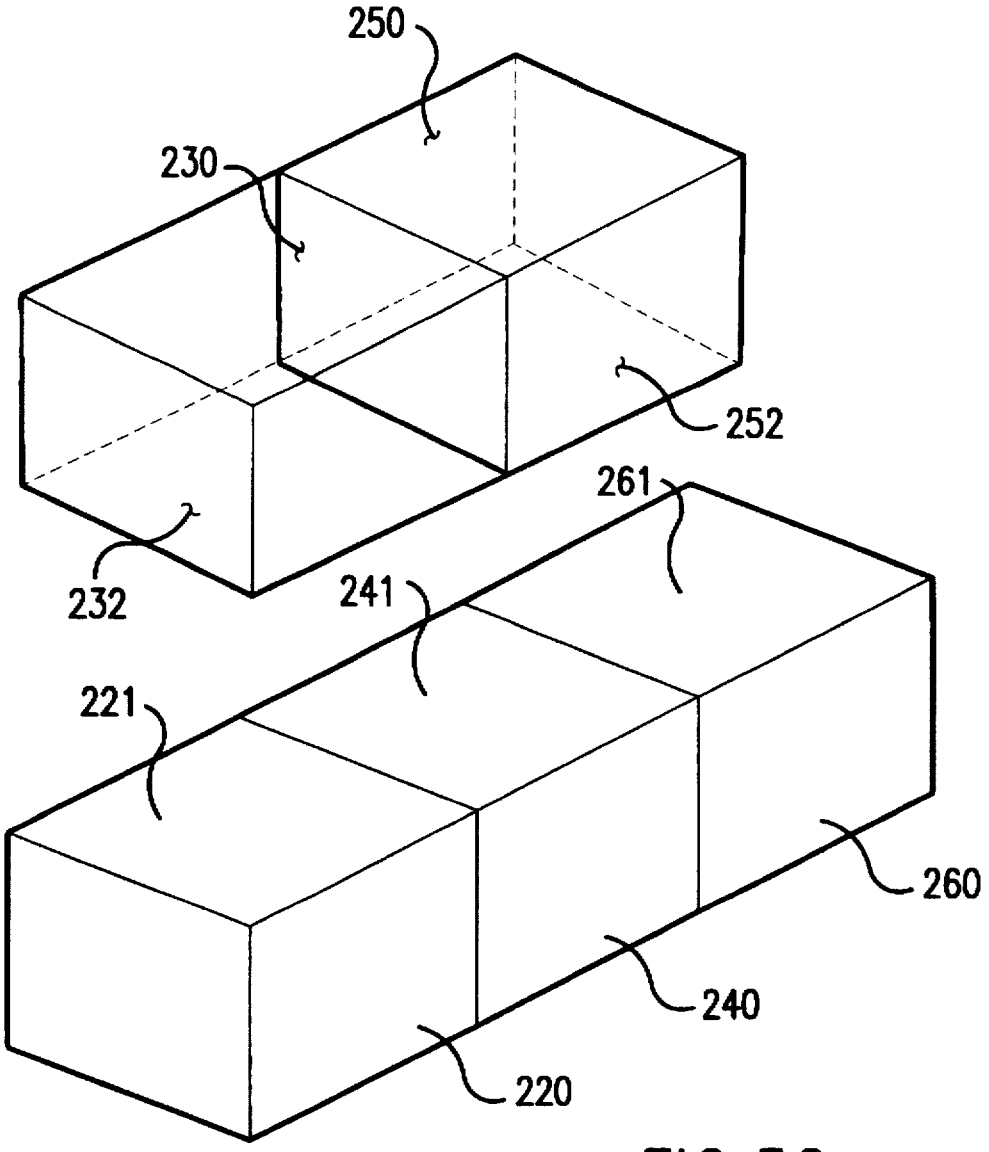
FIG. 5C is a perspective view of the magnetic field latch assembly of FIG. 5A.

FIG. 5B is a perspective view of the magnetic field latch assembly 210, showing only the magnets 220–260. FIG. 5C shows the orientation of the magnetic poles of the magnets 220–240. Thus, magnetic poles 232 and 241 are south magnetic poles, and 221, 252, and 261 are north magnetic poles. FIG. 5C also shows that the surfaces 221, 241 and 261 of the magnets 220, 240 and 260 are in a plane below the plane containing the surfaces 232 and 252 of the magnets 230 and 250.

FIG. 5C shows the apparatus 200 with the carriage 202 in the engaged position. As shown in FIG. 5C, magnets 220, 240 and 260 have passed below magnets 230 and 250. In the engaged position, the magnetic poles 232 and 252 provide alternately repelling and attracting forces between magnetic poles 221, 241 and 261. When in the engaged position, the magnetic latch minimizes vibrations caused by operation of the apparatus 200 such as rotational movements of the movable and stationary elements 204 and 201.

Figure 6A:
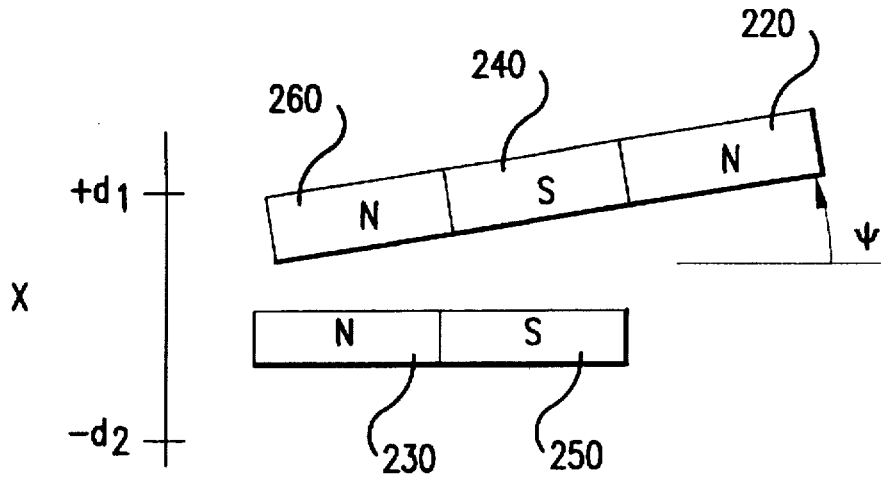
FIG. 6A is a simplified view of the magnetic field latch assembly of FIG. 5A.
Figure 6B:
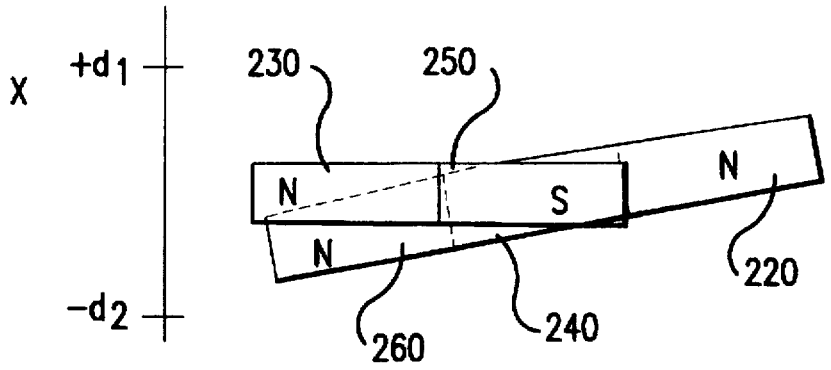
FIG. 6B is a second simplified view of the magnetic field latch assembly of FIG. 5B.
Figure 6C:
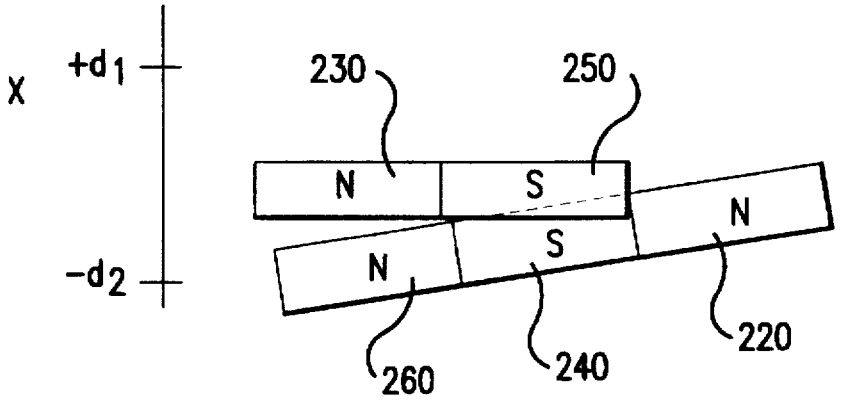
FIG. 6C is a third simplified view of the magnetic field latch assembly of FIG. 5A.

FIGS. 6A–6C show simplified views of the magnets 220–260 as the carriage 202 moves from the disengaged position to the engaged position. Prior to moving the carriage 202 to the engaged position, the orientation and longitudinal position of the magnets 220, 240 and 260 are adjusted to provide the desired repelling and latching forces. In this example, magnets 220, 240 and 260 have not been moved outward along longitudinal axis 218. Also, as shown in FIG. 6A, the magnets 220, 240 and 260 begin at a position $+d_1$, and, as shown in FIG. 6C, move to a position $-d_2$ corresponding to the engaged position. Thus, the total distance traveled is the distance between $+d_1$ and $-d_2$.

Figure 7:
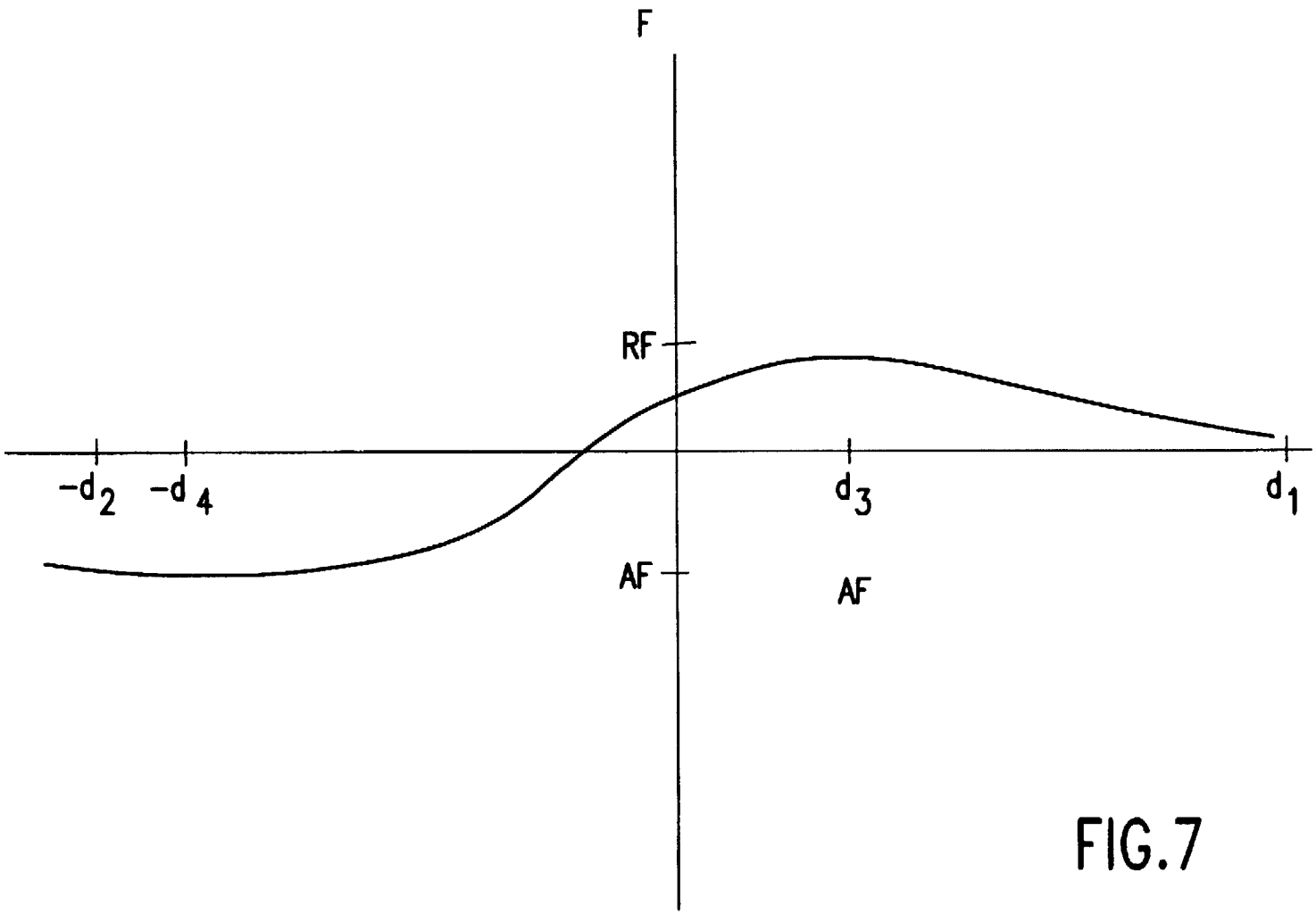
FIG. 7 shows a graph of net magnetic forces acting on the first and second elements shown in FIGS. 6A–6C.

As the carriage 202 moves towards the stationary element 203, the magnetic poles 221, 232, 241, 252 and 261 create a force F which tends to slow the motion of the carriage 202 towards the stationary element 203. As shown in FIG. 7, the force F in the +x, or separating direction, begins to increase as the carriage 202 moves towards the engaged position. The arrangement of the magnets 220–260 as the carriage 202 moves toward the engaged position is shown in FIG. 6C. The maximum separating force of RF is reached at a position $d_3$. As the distance between the carriage 202 and the stationary element 203 decrease, the separating force in the disengaging direction decreases.

As the magnets 220, 240 and 250 slide beneath the magnets 220 and 240, as shown in FIG. 6B, the force F passes through a zero value at position $d_2$ and then acts in an engaging direction. As shown in FIG. 6C, magnets 230 and 260 repel each other, for example, creating a force in the engaging direction. This force F approaches a maximum value of AF in the engaging direction at the engaged position $-d_2$.

The magnets associated with the stationary element 203, i.e., magnets 230 and 250, and the magnets associated with the movable element 202, i.e., magnets 220, 240 and 260 may be any combination of electromagnets, iron magnets or ceramic magnets. If electromagnets are used, the poles of the magnets 230 and 250 are activated to the same polarity as the magnetic poles of the magnets 240 and 260 during the motion of the carriage 202 towards the stationary element 203. When the carriage 202 is in position against the carriage stops 235, the polarities of the magnetic poles of magnets 220, 240 and 260 are reversed to provide a magnetic latch.

While this invention has been described in conjunction with specific embodiments thereof, it is evident that many alternatives, modifications, and variations will be apparent to those skilled in the art. Accordingly, preferred embodiments of the invention as set forth herein are intended to be illustrative, not limiting. Various changes may be made without departing from the spirit and scope of the invention as defined in the following claims.

What is claimed is:

1. A magnetic field latch assembly, comprising:

a first magnet associated with a first element;

a second magnet associated with a second element, the second element having a disengaged position and an engaged position with respect to the first element; and adjustment means for adjusting a position of at least one of the first magnet and the second magnet, the adjustment means allowing adjustment of at least an angular position of the first magnet relative to the second magnet, wherein a force between the first and the second magnets tends to separate the first and the second elements when in the disengaged position and the force between the first and the second magnets tends to draw the first and the second elements together when in the engaged position.

2. The magnetic field latch assembly of claim 1, wherein a longitudinal axis of the second magnet is in a first plane that is parallel to a second plane containing longitudinal axes of the first and the second elements, the first plane being substantially parallel to the second plane, the first and the second magnets overlapping when the first and the second elements are in the engaged position.

3. The magnetic field latch assembly of claim 2, wherein the first and the second magnets include a plurality of magnets, each of the plurality of magnets having a pole surface that is aligned with pole surfaces of other ones of the plurality of magnets, magnet axes of the plurality of magnets being aligned in a third plane, the third plane being substantially parallel to the second plane.

4. The magnetic field latch assembly of claim 2, wherein the first and the second magnets include a plurality of magnets, each of the plurality of magnets having a pole surface that is aligned with pole surfaces of other ones of the plurality of magnets, magnet axes of the plurality of magnets being aligned in a third plane, the third plane being perpendicular to the second plane.

5. The magnetic field latch assembly according to claim 4, wherein the first and the second magnets contact each other when in the engaged position.

6. The magnetic field latch assembly according to claim 4, wherein the adjustment means further allows adjustment of a longitudinal position of the first magnet relative to the second magnet.

7. The magnetic field latch assembly according to claim 6, wherein the adjusting means includes a flexible lever.

8. The magnetic field latch assembly according to claim 5, wherein the first magnets are permanent magnets and the second magnets are electromagnets.

9. The magnetic field latch assembly according to claim 5, wherein the second magnets are permanent magnets and the first magnets are electromagnets.

10. The magnetic field latch assembly according to claim 1, wherein the first and the second magnets are at least one of iron magnets, ceramic magnets and electromagnets.

11. The magnetic field latch assembly according to claim 10, wherein the first and the second magnets are electromagnets and magnetic poles of the electromagnets are activated to apply a braking force between the first and the second elements when the first and the second elements are in the disengaged position, and the magnetic poles of the electromagnets and are reversed, applying an attracting force between the first and the second elements when the first and the second elements are in the engaged position to latch the first and the second elements.

12. The magnetic field latch assembly of claim 1, wherein the first and second magnets repel each other in a first direction when the first and the second elements are in the disengaged position and repel each other in a second direction when the first and the second elements are in the engaged position, the first and second directions being different.

13. The magnetic field latch assembly of claim 12, wherein the first magnets include a first number of magnets and the second magnets include a second number of magnets.

14. The magnetic field latch assembly of claim 13, wherein the first number of magnets is two and the second number of magnets is three, the three magnets arranged so that magnetic poles of a center magnet of the second number of magnets are of opposite polarity to magnetic poles of each of an outer magnet of the second number of magnets.

15. The magnetic field latch assembly of claim 1, further comprising:

shields that enclose the first and the second magnets.

16. The magnetic latch assembly according to claim 4, wherein the first and the second magnets contact each other beginning immediately before the engaged position, so as to provide a frictional force for slowing a motion of the first element toward the second element.

17. A magnetic field latch assembly, comprising:

at least a first magnet associated with a first element;

at least a second magnet associated with a second element, the second element having a disengaged position and an engaged position with respect to the first element; and a lever coupled to the second magnet, the lever allowing adjustment of at least an angular position of the second magnet relative to the first magnet, wherein the first and the second magnets repel each other in a first direction when the first and the second elements are in the disengaged position and the first and the second magnets repel each other in a second direction when the first and the second elements are in the engaged position, the first and the second directions being different.

18. The magnetic field latch assembly according to claim 17, wherein the lever further allows adjustment of a longitudinal position of the second magnets.

19. The magnetic latch assembly according to claim 18, wherein the first and the second magnets contact each other beginning immediately before the engaged position so as to provide a frictional force for slowing a motion of the first element toward the second element.

* * * * *